US006132530A

United States Patent [19]

Zuliani et al.

[11] Patent Number: 6,132,530

[45] **Date of Patent: *Oct. 17, 2000**

[54] STRONTIUM-ALUMINUM INTERMETALLIC ALLOY GRANULES

[75] Inventors: Douglas J. Zuliani, Stittsville; Bahadir Kulunk, Renfrew, both of Canada

[73] Assignee: Timminco Limited, Toronto, Canada

[ * ] Notice: This patent is subject to a terminal disclaimer.

[21] Appl. No.: 09/189,630

[22] Filed: Nov. 10, 1998

Related U.S. Application Data

[63] Continuation of application No. 08/672,758, Jun. 28, 1996, Pat. No. 5,882,443.

[51] Int. Cl.[7] ..... C22C 21/00

[52] U.S. Cl. ..... 148/437; 420/549; 420/528; 75/249

[58] Field of Search ..... 148/437; 420/549, 420/528; 75/249

[56] References Cited

U.S. PATENT DOCUMENTS

| | | | |
|---|---|---|---|
| 3,466,170 | 9/1969 | Dunkel et al. | 420/540 |
| 3,567,429 | 3/1971 | Dunkel et al. | 420/578 |
| 4,009,026 | 2/1977 | Rasmussen | 420/549 |
| 4,108,646 | 8/1978 | Gennone et al. | 420/549 |
| 4,576,791 | 3/1986 | Thistlethwaite | 420/552 |
| 5,045,110 | 9/1991 | Vader et al. | 75/338 |
| 5,205,986 | 4/1993 | Noordegraaf et al. | 420/528 |

FOREIGN PATENT DOCUMENTS

| | | |
|---|---|---|
| 0 421 549 A1 | 4/1991 | European Pat. Off. . |
| 1196405 | 12/1985 | U.S.S.R. . |
| 1 583 083 | 1/1981 | United Kingdom . |
| WO 91/05069 | 4/1991 | WIPO . |

OTHER PUBLICATIONS

Gruzleski et al, "The Treatment of Liquid–Aluminum–silicon alloys," The American Foundrymen's Society, Inc., pp. 31–39.

Pekguleryuz et al, "Conditions for Strontium Master Alloy . . . ," Trans. Am. Foundrymen's Soc., No. 96, pp. 55–64 (1988); XP002042477.

Pekguleryuz, M.O., "Strontium dissolution in Liquid Aluminum . . . ," Diss. Abstr. Int., vol. 48, No. 10, p. 3093–B (1988); XP002042478.

*Primary Examiner*—Sikyin Ip

*Attorney, Agent, or Firm*—Nixon & Vanderhye

[57] ABSTRACT

Aluminum-strontium enriched master alloy granules for use primarily in modifying the eutectic phase in aluminum-silicon casting alloys. The master alloy granules are predominantly intermetallic compounds $Al_4Sr$, $Al_2Sr$ or AlSr and mixtures thereof. By using such intermetallic dominant alloys in a granulated state rapid dissolution in aluminum-silicon alloy melts is achieved. The master alloy composition can be directly added to a content of the melt or injected into it. The master alloy composition can also be mixed with aluminum granules and extruded into a rod or entrained into a billet of cast aluminum.

9 Claims, 5 Drawing Sheets

STRONTIUM-ALUMINUM INTERMETALLIC ALLOY GRANULES

This is a continuation of application Ser. No. 08/672,758, filed Jun. 28, 1996, now U.S. Pat. No. 5,882,443.

BACKGROUND OF THE INVENTION

1. Field of the Invention

This invention relates to aluminum-strontium alloys for use primarily in modifying the eutectic phase in aluminum-silicon casting alloys or modifying intermetallic phases in wrought aluminum alloys.

2. Description of Related Art

Because of their excellent fluidity and castability, eutectic and hypoeutectic aluminum-silicon alloys are widely used in the production of aluminum castings. In an unmodified state, the eutectic silicon phase is present as coarse plates with sharp sides and ends often referred to as acicular silicon. The presence of acicular silicon results in castings which have low percent elongation, low impact properties and poor machinability.

Strontium has been shown to be effective in refining or modifying coarse acicular silicon into a fine, interconnected fibrous structure. In general, small quantities of strontium between 100 to 200 ppm are sufficient to produce a fine, fibrous eutectic silicon which in turn significantly improves the mechanical properties and machining characteristics of the aluminum casting. U.S. Pat. No. 3,466,170 issued September 9, 1969 to Dunkel et al. recognizes the benefit of adding strontium either as a pure metal or as an AlSr alloy with 7 net percent Sr.

Because strontium metal is very reactive with oxygen, nitrogen and moisture, its use as a modifying agent is limited. In most cases, strontium is added in the form of a master alloy. U.S. Pat. No. 3,567,429 issued Mar. 2, 1971 to Dunkel et al. teaches the use of a strontium-silicon-aluminum master alloy which has a strontium content higher than 7%. Strontium-silicon-aluminum master alloys are no longer widely used for modifying aluminum-silicon casting alloys, since in most cases the strontium is present as a high melting temperature intermetallic phase such as $Al_2Sr_2Si$ or $SrSi_2$ which dissolves very slowly at molten aluminum processing temperatures, typically 760° C. or lower. As reported by John E. Gruzleski and Bernard M. Closset ("The Treatment of Liquid Aluminum-Silicon Alloys", American Foundrymen's Society Inc., 1990, pages 31–39), a 10% strontium-aluminum binary master alloy dissolves twice as fast in a A356 aluminum-silicon casting alloy as a 10% strontium-14% silicon-aluminum ternary master alloy at all melt temperatures ranging between 670 to 775° C. Similar results are found in U.S. Pat. No. 5,045,110, issued Sep. 3, 1991 to Vader et al., reporting dissolution times between 20 and 30 minutes for 10% strontium-14% silicon-aluminum master alloys in ingot form. In contrast, U.S. Pat. No. 4,576,791, discussed below, teaches that 5–10% strontium-aluminum binary alloys in rod form and which contain titanium and boron grain refiners dissolve in 1 minute. In addition, the customary process used to produce strontium-silicon master alloys results in substantial quantities of detrimental impurities including iron, barium and calcium often being present in the master alloy.

U.S. Pat. No. 4,108,646 teaches the use of a master composition consisting of strontium-silicon in particulate form pressed into a briquette with aluminum or aluminum-silicon particles. The briquettes, having a master composition of between 3 to 37% strontium by weight, are then added to an aluminum-silicon casting alloy to modify its structure. This master composition is less efficient than aluminum-strontium binary master alloys since the strontium is present as $SrSi_2$ particles which, as discussed above, dissolve slowly and contain detrimental impurities including up to 4% iron and 1 to 3% calcium.

Aluminum-strontium binary alloys are now widely used for modifying aluminum castings; however, it has been difficult to increase the strontium content of these binary master alloys. This is best explained in the context of the aluminum-strontium binary equilibrium phase diagram of FIG. 1. The phase diagram contains two low melting point eutectics, one at about 3.5% strontium, the second at 90% strontium. On the aluminum rich side, the eutectic containing alloys range from about 0% to 44% strontium. On the strontium rich side, the eutectic containing alloys range from about 77% to 100% strontium. In the final solidified state, these eutectic alloys contain in varying proportions a eutectic phase which is very finely divided and melts at low temperatures, 654° C. in the case of the aluminum rich eutectic and 580° C. for the strontium rich eutectic. These finely divided eutectic phases are more ductile and dissolve more rapidly than the higher melting point intermetallic alloy phases which are present between about 44% to 77% strontium. Since these intermetallic alloys contain no low melting point, finely divided eutectic phase, they are more brittle and dissolve much more slowly than the eutectic containing alloys. The presence of these high melting point intermetallics alloys has placed a significant limitation on the amount of strontium which can be effectively contained in commercial aluminum-strontium binary master alloys. In this specification, the term "intermetallic alloys" denotes alloys containing between approximately 40% to 81% strontium by weight. These alloys are dominated by the $Al_4Sr$, $Al_2Sr$ and AlSr intermetallics and contain only minimal or no eutectic phase.

As discussed in "Phase Diagrams for Ceramists" compiled by the National Bureau of Standards, published by The American Ceramic Society Inc., Volume 1, pages 9–14, FIG. 1 as a binary equilibrium phase diagram shows the relationships between composition and temperature assuming all phases are in equilibrium with each other. These compositional relationships are only valid if the rate of solidification is slow enough to allow the phases to reach compositional equilibrium at every instant. A more rapid rate of solidification will lead to quite different compositional results.

As shown in FIG. 1, when a liquid alloy containing 10% strontium is cooled, solidification begins at about 815° C. The first solid phase to precipitate is primary $Al_4Sr$ intermetallic which contains approximately 44% strontium. As the melt temperature continues to decrease during solidification, more and more of this primary $Al_4Sr$ intermetallic phase precipitates. The primary $Al_4Sr$ intermetallic phase is present as massive interconnected plates or needles which are shown two-dimensionally in the photomicrograph given in FIG. 2. A three-dimensional view of the interconnected network of primary $Al_4Sr$ plates is shown by FIG. 3 taken using a stereomicroscope.

When the melt temperature cools to 654° C., the primary $Al_4Sr$ intermetallic phase stops precipitating and the remaining amount of liquid alloy solidifies as a very finely divided, ductile eutectic phase. The eutectic phase is shown in FIG. 2 by the light regions surrounding the large primary $Al_4Sr$ needles. The eutectic phase is much more finely divided than the $Al_4Sr$ intermetallic phase as evidenced by the lack of resolution of the eutectic phase at 50 times magnification.

The quantity of primary intermetallic $Al_4Sr$ phase present in the final solidified alloy will depend on the rate at which freezing took place between 815° C. to 654° C. If the alloy were allowed to freeze very slowly so that equilibrium is achieved at each instant of cooling, then the quantity of primary $Al_4Sr$ intermetallic phase in the final alloy will be given from the equilibrium phase diagram in FIG. 1 using the lever rule, that is for a 10% strontium alloy $$\% \text{ Primary } Al_4Sr \text{ Phase in Final Alloy} = \frac{(10\% - 3.5\%)}{(44\% - 3.5\%)} = 16\%$$

$$\% \text{ Eutectic Phase in Final Alloy (by difference)} = 84\%$$

As discussed in "Phase Diagrams for Ceramists" above, a more rapid rate of solidification which does not allow phase equilibrium at each instant will lead to quite different compositional results.

A more rapidly solidified alloy will contain less than 16% primary $Al_4Sr$ intermetallic phase with the quantity of primary $Al_4Sr$ decreasing as the rate of freezing increases. This reduction in the quantity of the primary $Al_4Sr$ intermetallic phase as the rate of solidification increases is due to the shorter period of time spent by the freezing alloy in the 815° C. to 654° C. temperature range where the primary $Al_4Sr$ precipitates. Hence rapid solidification leads to less primary intermetallic phase and correspondingly an increase in the quantity of eutectic phase in the final solidified alloy. For a 10% strontium-90% aluminum master alloy, the maximum quantity of primary $Al_4Sr$ intermetallic phase is 16%, and correspondingly the minimum quantity of eutectic phase is 84%, which occurs when cooling rates are slow enough to allow for phase equilibria.

U.S. Pat. No. 4,576,791 states that a 10% strontium-aluminum alloy rod, which contains a maximum of only 16% primary $Al_4Sr$ intermetallic phase and at the very minimum 84% finely divided eutectic phase, normally dissolves so slowly as to be unsuitable for use as master alloy in rod form. This is due to the presence of relatively large crystals of $Al_4Sr$ primary intermetallic phase ranging from 5 to 300 microns as viewed two-dimensionally through a microscope. The patentee meets this problem by providing 0.2 to 5% titanium and up to 1% boron in the master alloy to refine the typical $Al_4Sr$ primary intermetallic two-dimensional crystal size to 20 to 100 microns. Reducing the size of the $Al_4Sr$ primary intermetallics increases the ductility of the rod thereby enabling it to be coiled and uncoiled during feeding and also shortens the dissolution time to approximately 1 minute which is required for launder additions. The addition of titanium and boron enables strontium concentrations in the master alloy to be increased to 20% Sr by weight, in the preferred embodiment to 10% Sr. Refining the size of the primary $Al_4Sr$ intermetallic phase is effective up to a maximum of 20% strontium beyond which the alloys are unsuitable for use in rod form.

In U.S. Pat. No. 4,576,791, the $Al_4Sr$ primary phase crystals are referred to as ranging from 5 to 300 microns in size. It is important to note, however, that this size description may be misleading since it is based on a two-dimensional microscopic view of a polished sample (FIG. 2). In actuality the primary intermetallic phase forms first during solidification as a three-dimensional network of crystals. Even though in a two-dimensional microscopic view the $Al_4Sr$ intermetallics appear as discrete needles sized less than 300 microns, in actuality these intermetallic crystals form an interconnecting network of plates surrounded by very finely divided eutectic phase which is the last phase to solidify. FIG. 3 shows the three-dimensional interconnected plates of $Al_4Sr$ primary intermetallic phase present in a 10% Sr-90% Al alloy. The amount of three-dimensional interconnection increases as the strontium concentration increases in the alloy. Hence, in the prior art there has been an upper strontium concentration limit. Beyond this upper strontium concentration limit, the three-dimensional network of interconnected primary phase intermetallic crystals becomes too large and the quantity of finely divided eutectic surrounding the plates too small rendering the alloy unusable due to the slow dissolution and brittleness of these large intermetallic networks.

A different approach to the problem caused by $Al_4Sr$ plates is found in U.S. Pat. Nos. 5,045,110 and 5,205,986, issued Sep. 3, 1991 and Apr. 27, 1993, respectively, in the name of Shell Research Ltd. These patents teach that the strontium concentration in binary aluminum rich-strontium master alloys can be increased to 30% or 35% Sr by weight by further refining the grain size and reducing the quantity of the $Al_4Sr$ primary intermetallic phase as a result of atomizing the liquid alloy at very rapid cooling rates of $10^2$ to $10^{4\circ}$ C./sec. By this process both the quantity and the size of the primary $Al_4Sr$ intermetallic phase which precipitates first is reduced and the quantity of finely divided, more ductile eutectic phase is increased proportionately.

FIG. 4 is a photomicrograph taken at 500 times magnification of a 10% strontium-90% aluminum alloy rod produced from a rapidly solidified atomized alloy as in U.S. Pat. Nos. 5,045,110 and 5,205,986. When compared to FIG. 2 which is a photomicrograph taken at only 50 times magnification (10 times lower magnification than FIG. 4) of a 10% strontium-90% aluminum alloy cast in a permanent mould at moderate solidification rates, it is evident that the rapid solidification rates resulting during atomization greatly reduces the size and quantity of the primary $Al_4Sr$ intermetallic phase. Titanium and boron may also be added to the master alloy to further refine the structure. By reducing the quantity and refining the size of the primary $Al_4Sr$ intermetallic phase and also increasing the quantity of very finely divided, ductile eutectic phase, the patents teach that the strontium concentration in aluminum-strontium master alloys can be increased up to 35% Sr by weight. The atomized solid particles, each of which contains both a finely divided $Al_4Sr$ intermetallic phase and a eutectic phase, are consolidated by an extrusion process into a rod for in-line addition to a launder, this rod having "sufficient ductility to enable coiling and decoiling".

Although as detailed by Gruzleski and Closset above, a 90% strontium rich-aluminum master alloy is also available but is of limited use as a master alloy. This strontium rich master alloy consists of 100% finely divided eutectic phase with no intermetallic phases present and has very limited application since it can only be used when the aluminum-silicon casting alloy melt temperature is below about 720° C. When added to an aluminum alloy melt, the 90% strontium alloy first melts and the 90% strontium enriched liquid then dissolves to dilute levels of 150 to 200 ppm Sr. During this dissolution, the local liquid composition must become diluted from 90% strontium down to less than 0.02% Sr (150–200 ppm Sr). During this dilution, the local melt composition must pass through the range of high melting point intermetallic alloy compositions from 77% to 44% strontium and these intermetallic phases will precipitate during dissolution as solid intermetallic phases which stop or further retard strontium dissolution. At melt temperatures below 720° C., the 90% strontium alloy dissolves exothermically releasing sufficient heat to raise the aluminum-silicon alloy melt temperature locally to a sufficiently high level as to avoid the formation of the high melting $Al_4Sr$ and $Al_2Sr$ intermetallic phases. Hence at melt temperatures below 720° C., the 90% Sr-10% Al alloy dissolves rapidly with high recovery. At melt temperatures above about 720° C., this exothermic reaction diminishes and insufficient heat is generated. This results in the formation of the $Al_2Sr$ and $Al_4Sr$ intermetallic phases during dissolution. The presence of the high melting $Al_4Sr$ and $Al_2Sr$ intermetallic phases effectively retards dissolution and results in poor strontium recovery.

Thus, as taught by the prior art discussed above, the presence of high melting point primary intermetallic phases between 44% and 77% strontium by weight has placed significant limitations on the use of aluminum-strontium master alloys.

Hitherto, the useful aluminum-strontium master alloys have been alloys which contain substantial quantities of very finely divided, ductile, low melting point eutectic phase. In the case of aluminum rich-strontium master alloys ranging from 5 to 35% strontium, the alloy consists of a mixture of primary $Al_4Sr$ intermetallic phases surrounded by finely divided eutectic phase. The primary $Al_4Sr$ intermetallic phase is present as a three-dimensional network of interconnected plates which under normal solidification rates can be quite coarse in size. All of the prior art teaches that the only method of increasing the strontium concentration in these aluminum rich master alloys while allowing acceptable rates of dissolution of the alloys in molten aluminum is to minimize the quantity and refine the size of the interconnected network of $Al_4Sr$ plates and to maximize the quantity of the more ductile, very fine eutectic phase.

SUMMARY OF THE INVENTION

The present invention is based on the discovery that the intermetallic dominant alloys which characterize compositions between about 40% to 81% strontium and consist principally of the intermetallic phases $Al_4Sr$, $Al_2Sr$ and AlSr which were previously considered detrimental to conventional Al—Sr master alloys, because of their slow dissolution characteristics, can be adapted for use in adding strontium to modify aluminum-silicon casting alloy melts. Unlike the prior art which is based on alloys containing large amounts of eutectic phase, the alloys in the present invention contain only minimal quantities and in most cases no eutectic phase. The intermetallic phases are present as adjoining discrete phases and embedded in a matrix of eutectic phase not interconnected in a network of platelets embedded in a matrix of eutectic phase.

FIG. 5 shows a photomicrograph at 125 times magnification of an intermetallic alloy from the present invention containing 55% strontium and 45% aluminum. This alloy contains 2 intermetallic phases $Al_4Sr$ and $Al_2Sr$ with no eutectic phase present and has a microstructure which is significantly different from the previously known aluminum-strontium eutectic containing alloys shown in FIG. 2.

Surprisingly, it has now been determined that all the intermetallic alloy compositions, that is $Al_4Sr$ at 44% Sr by weight, $Al_2Sr$ at 62% Sr by weight and AlSr at 77% Sr by weight, as well as mixtures of the intermetallic alloys with small amounts of the eutectic phase and characterized by an overall composition of 40% to 81% strontium by weight, dissolve rapidly when added as discrete granules to aluminum-silicon casting alloy melts. The rapid dissolution of these intermetallic alloys is surprising for several reasons:

the prior art discussion of aluminum rich-strontium master alloys indicates that their performance is determined by the size and quantity of the primary $Al_4Sr$ intermetallic phase which is present as a network of interconnected platelets within the matrix of eutectic phase. The present invention is capable of using strontium alloys from 40 to 81% strontium concentration because the intermetallic alloys $Al_4Sr$, $Al_2Sr$ and AlSr and mixtures thereof are present as three-dimensionally discrete particles, not as an interconnected network of platelets. In the current invention, intermetallic alloy particles forming part of an overall composition having between 40 to 81% strontium can be as large as 5000 microns or 50 to 500 times larger than the size of the $Al_4Sr$ intermetallic particles discussed in the prior art. Hence it is surprising, based on prior art, that particles as large as 5000 microns containing strontium concentrations as high as about 81% dissolve so rapidly with high strontium recovery.

the dissolution of the 90% strontium rich-10% aluminum eutectic alloy which is richer in strontium than the intermetallic alloys of the present invention is only effective when added to melts at temperatures below 720° C. This is because the alloy releases exothermic heat below 720° C. which locally raises the aluminum melt temperature above the melting points of the intermetallic alloys. At melt temperatures above 720° C., insufficient exothermic heat is released to raise the local melt temperature. As a result at melt temperatures above 720° C., as the 90% strontium enriched liquid from the melting of the master alloy becomes diluted during dissolution, high temperature intermetallic phases AlSr (77% Sr), $Al_2Sr$ (62% Sr) and $Al_4Sr$ (44% Sr) precipitate as solid and greatly retard the rate of dissolution and lower the recovery of strontium. Based on this information, it would be expected that the intermetallic alloys which contain up to about 81% Sr would also require the release of exothermic heat to dissolve rapidly and hence would be ineffective at melt temperatures above 720° C. The same exothermic effect is not evident, however, when using intermetallic alloy granules of the present invention as strontium recovery and dissolution rate are excellent even at melt temperatures of 750° C. Also the dissolution rate of the intermetallic alloy granules with strontium concentrations greater than 44% is not impeded by the formation of the higher melting point phases during dissolution as would be expected based on the 90% strontium-10% aluminum eutectic alloy.

BRIEF DESCRIPTION OF THE DRAWINGS

FIG. 5 shows the microstructure at 125 times magnification of a 55% Sr-45% Al alloy which contains two intermetallic phases $Al_4Sr$ and $Al_2Sr$ and no eutectic phase. FIG. 6 shows the microstructure at 50 times magnification of a 10% Sr-90% Al alloy rod prepared by mixing the appropriate amounts of aluminum granules and $Al_4Sr$ intermetallic alloy granules and subsequently continuously extruding the mixture into a ⅜" diameter rod. FIG. 7 shows the microstructure at 50 times magnification of a 20% Sr-80% Al alloy prepared by entraining solid $Al_4Sr$ intermetallic alloy granules in a liquid Al melt. FIG. 8 shows the microstructure at 50 times magnification of a 20% Sr-80% Al alloy prepared by entraining the appropriate amount of solid $Al_4Sr$ intermetallic alloy granules into a 10% Sr-90% Al liquid melt.

DESCRIPTION OF THE PREFERRED EMBODIMENTS

Figure 1:
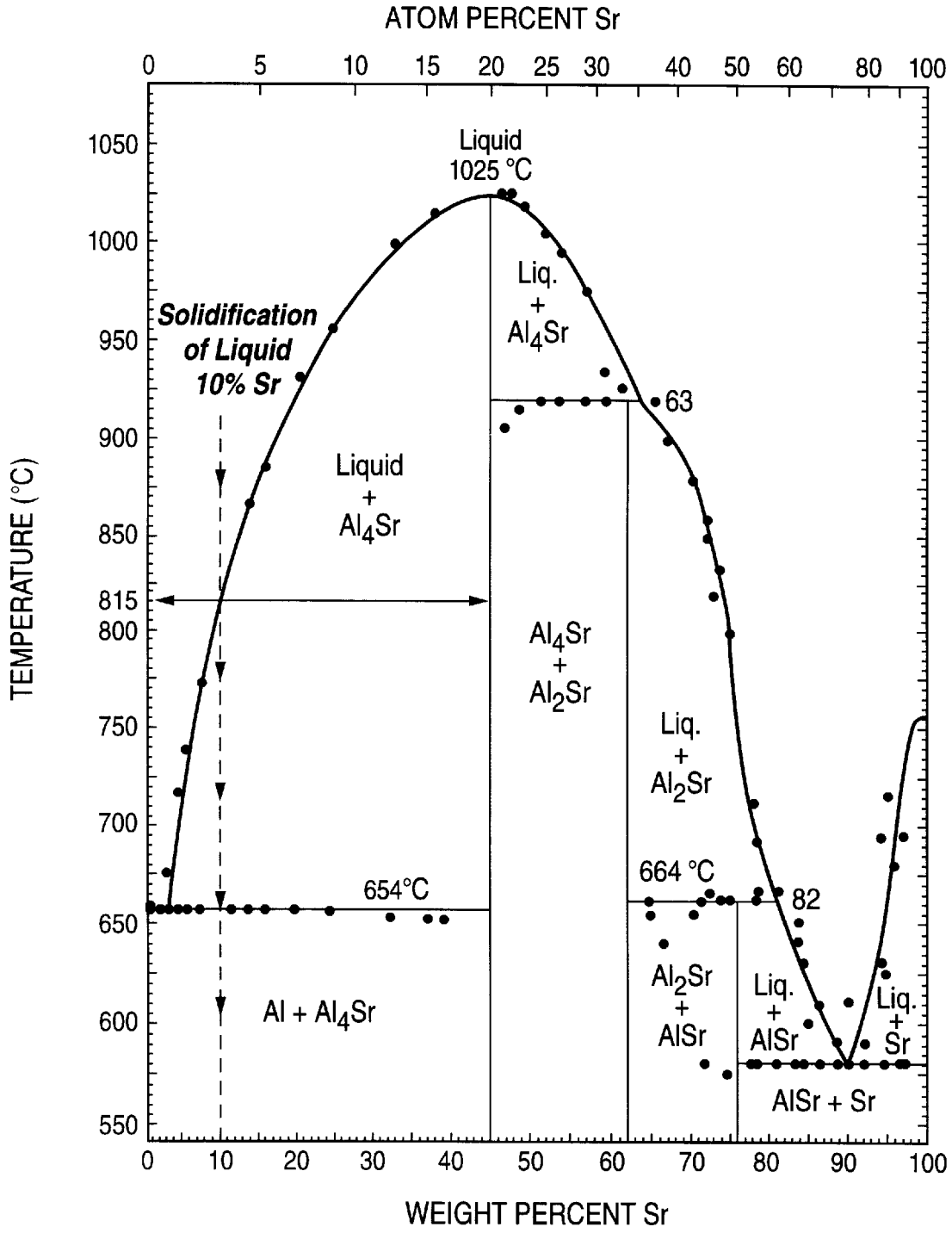
FIG. 1 shows the aluminum-strontium binary equilibrium phase diagram.

The intermetallic alloy granules in accordance with the present invention are produced by first melting and then alloying. The alloys can be prepared by either starting with an aluminum melt and alloying with the appropriate amount of strontium metal or first melting strontium metal and subsequently alloying with the appropriate amount of aluminum metal. Care must be taken to ensure that the strontium rich melts are protected from the atmosphere by an inert gas such as argon. In addition care must be taken, especially for aluminum rich melts, to limit the amount of hydrogen pickup from atmospheric humidity. The alloying is usually conducted at melt temperatures with at least 50° C. superheat above the temperature where solidification begins. Since these intermetallic alloys are brittle in the solid state, granules can be produced by comminution using standard crushing and grinding techniques.

The optimum screen size distribution of the strontium-aluminum intermetallic alloy granules depends on the method of use. For applications involving direct addition onto the surface of the melt or into a stirred vortex in the melt or plunging below the melt surface or a pour over method where the melt is poured on top of the granules, granules with a screen size distribution of approximately 150 microns or less are acceptable. In the preferred embodiment, however, granules for these methods of application are approximately sized at 2500 microns or less.

For applications where the strontium-aluminum intermetallic alloy granules are premixed with other granular materials such as aluminum for compaction into briquettes or the like or consolidation by extrusion into rods or other shapes, a screen size distribution of about 2500 microns and less is acceptable while 500 microns and less is preferred and 150 microns and less is most preferred.

For applications where the strontium-aluminum intermetallic alloy granules are introduced into the melt using pneumatic subsurface injection through a lance or suitably designed rotary degasser, a screen size distribution of 2400 microns or less is acceptable with 850 microns or less being preferred.

For applications where the strontium-aluminum intermetallic alloy granules are physically entrained into an aluminum melt or an aluminum-strontium alloy melt for subsequent use as an enriched strontium-aluminum master alloy, a screen size distribution of approximately 3000 microns or less is acceptable with 500 microns or less preferred.

In many of the above applications, it may also be desirable but not necessary to minimize the amount of ultra fine particles that may be present in the strontium-aluminum intermetallic alloy granules such as below 74 microns or more preferably below 43 microns.

As strontium is known to be a highly reactive metal, the reactivity with atmospheric oxygen, nitrogen and humidity of the strontium-aluminum intermetallic alloy granules was also tested. As shown in Table I below, strontium-aluminum intermetallic alloy granules with a size distribution of 147 microns and less were exposed to the atmosphere at room temperature for a period up to 240 hours.

TABLE I

Strontium-Aluminum Intermetallic Alloy Granules (−147 microns); Weight Gain Due to Atmospheric Exposure at Room Temperature

| Intermetallic Alloy | | | Weight Gain After Hours Of Exposure | | | | | | | | | |
|---|---|---|---|---|---|---|---|---|---|---|---|---|
| | | Initial | 24 hrs | | 72 hrs | | 168 hrs | | 192 hrs | | 240 hrs | |
| wt % Sr | wt % Al | Wt gm | gm | % | gm | % | gm | % | gm | % | gm | % |
| 80 | 20 | 12.7800 | 0.1010 | 0.8 | 0.1722 | 1.3 | 0.2111 | 1.6 | 0.2230 | 1.7 | 0.2407 | 1.9 |
| 75 | 25 | 14.3742 | 0.0984 | 0.7 | 0.1558 | 1.1 | 0.1922 | 1.3 | 0.2058 | 1.4 | 0.2208 | 1.5 |
| 70 | 30 | 15.7018 | 0.0804 | 0.5 | 0.1201 | 0.8 | 0.1481 | 0.9 | 0.1591 | 1.0 | 0.1711 | 1.1 |
| 65 | 35 | 16.4972 | 0.0433 | 0.3 | 0.0626 | 0.4 | 0.0810 | 0.5 | 0.0875 | 0.5 | 0.0935 | 0.6 |
| 60 | 40 | 16.8018 | 0.0142 | 0.08 | 0.0175 | 0.10 | 0.0208 | 0.12 | 0.0225 | 0.13 | 0.0239 | 0.14 |
| 55 | 45 | 16.3624 | 0.0092 | 0.06 | 0.0101 | 0.06 | 0.0131 | 0.08 | 0.0141 | 0.09 | 0.0148 | 0.09 |
| 50 | 50 | 17.0397 | 0.0052 | 0.03 | 0.0069 | 0.04 | 0.0083 | 0.05 | 0.0098 | 0.06 | 0.0107 | 0.06 |
| 45 | 55 | 17.1828 | 0.0000 | 0 | 0.0000 | 0 | 0.0010 | 0.01 | 0.0018 | 0.01 | 0.0038 | 0.02 |
| 40 | 60 | | negligible weight gain | | | | | | | | | |

The results indicate that, as expected, the reactivity of the master alloy granules increases with increasing strontium concentration. Surprisingly, however, the degree reactivity even for 80% Sr-20% Al intermetallic alloy granules is not excessive and is well within the tolerance limits suitable for commercial production and use. By comparison, the previously known 90% Sr-10% Al eutectic alloy is very reactive with air and can spontaneously combust if exposed to excessive moisture or a spark. This 90% Sr alloy is classified as hazardous and must be shielded from the atmosphere by protective nonpermeable packaging.

Figure 2:
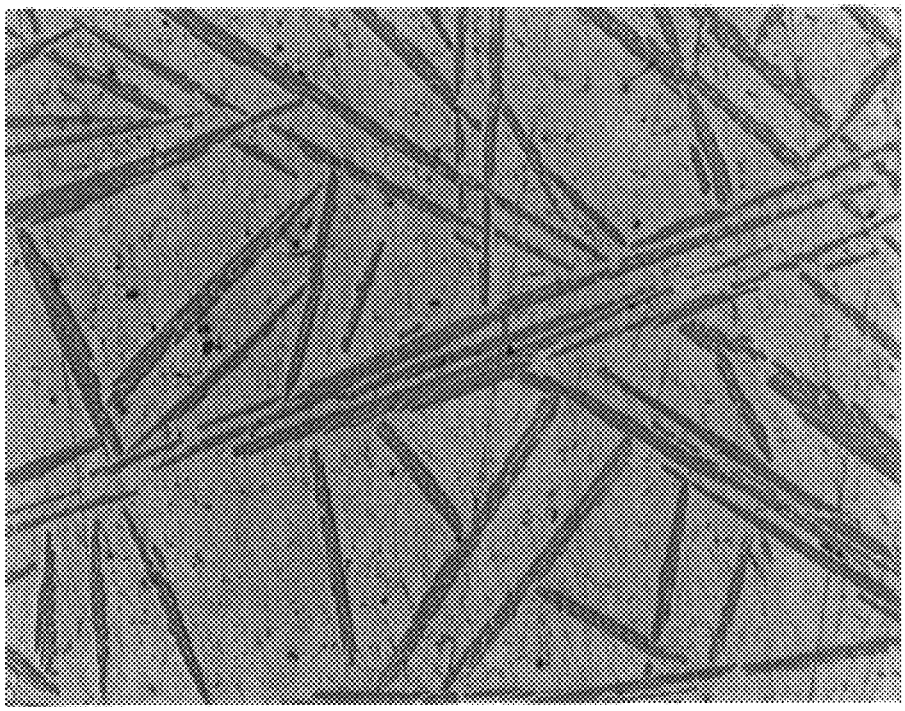
FIG. 2 shows $Al_4Sr$ intermetallic needles in a matrix of finely divided eutectic for a 10% Sr-90% Al master alloy as viewed at 50 times magnification.
Figure 3A:
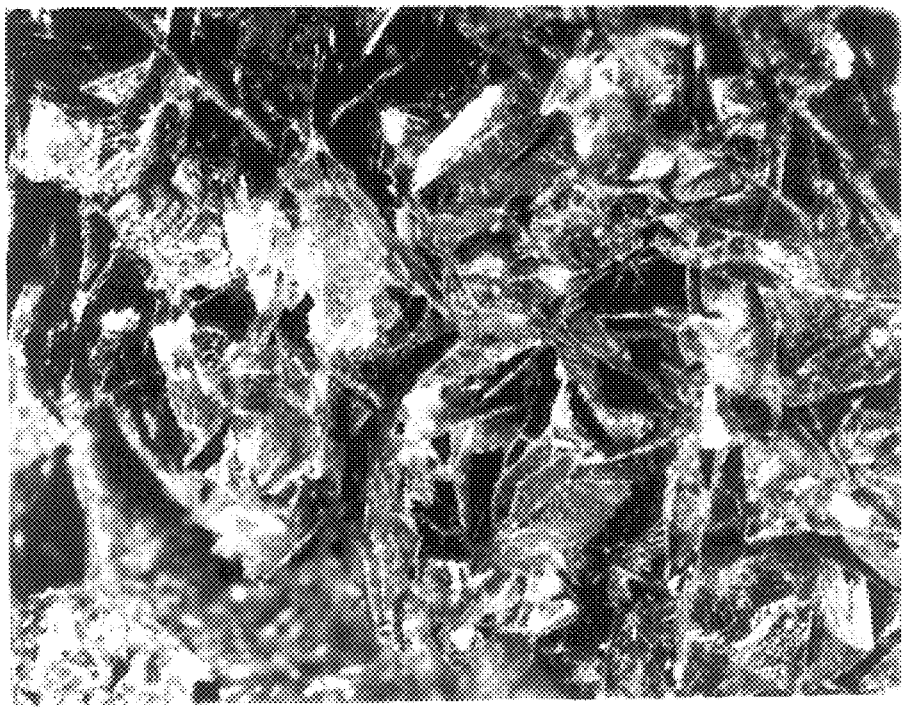
FIG. 3 shows the three-dimensional network of interconnected primary $Al_4Sr$ intermetallic plates present in eutectic containing alloys as viewed through a stereomicroscope.
Figure 3B:
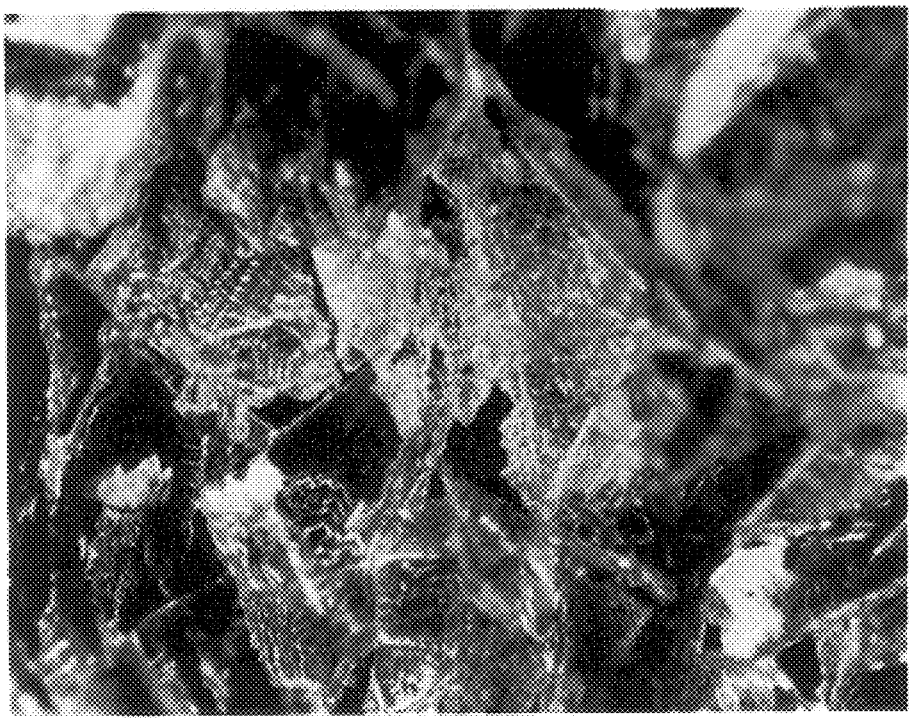
Figure 4:
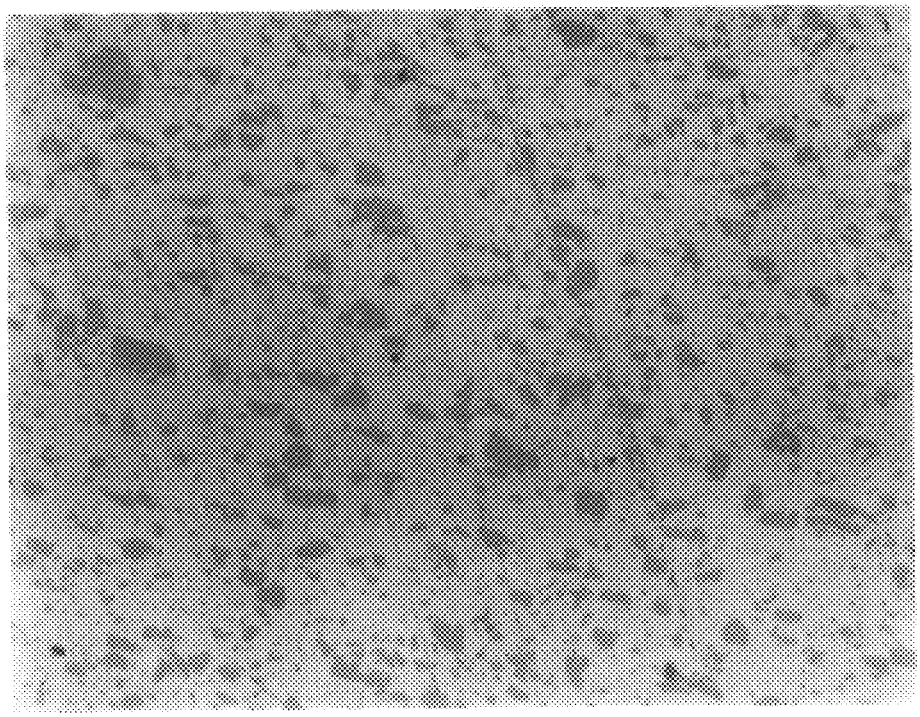
FIG. 4 shows a photomicrograph at 500 times magnification of a 10% Sr-90% Al alloy rod prepared by atomization and subsequent extrusion as per U.S. Pat. Nos. 5,045,110 and 5,205,986.
Figure 5:
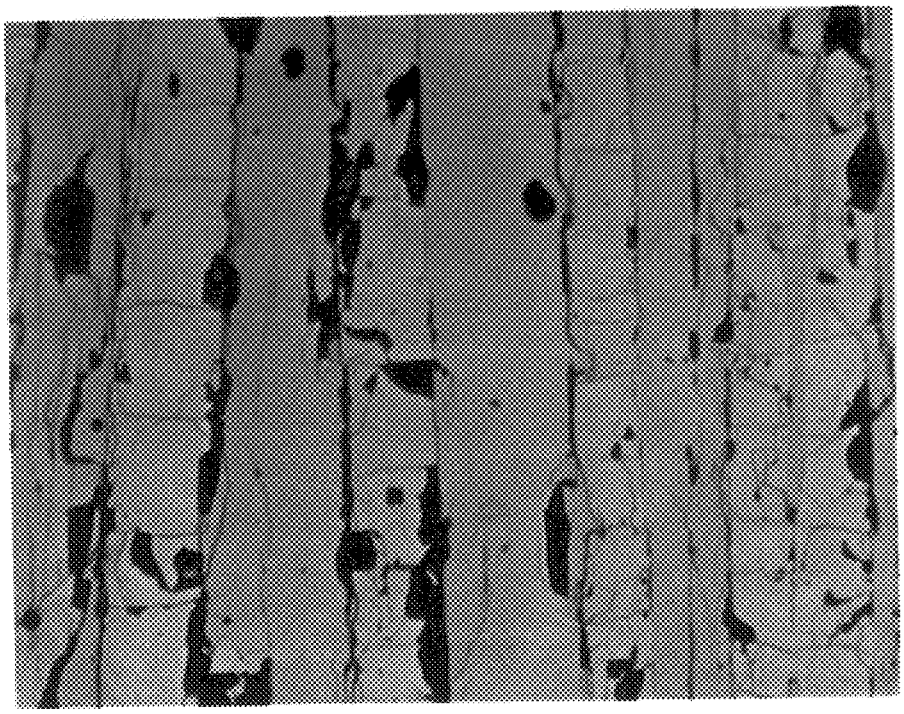
FIGS. 5, 6, 7 and 8 are photomicrographs of master alloys in accordance with the invention.
Figure 6:
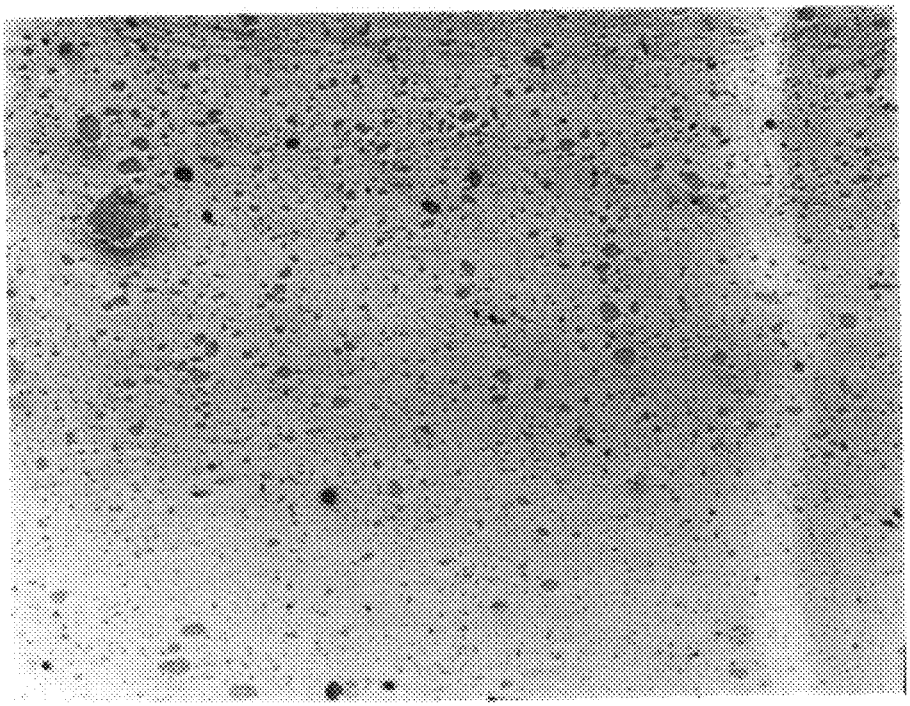
Figure 7:
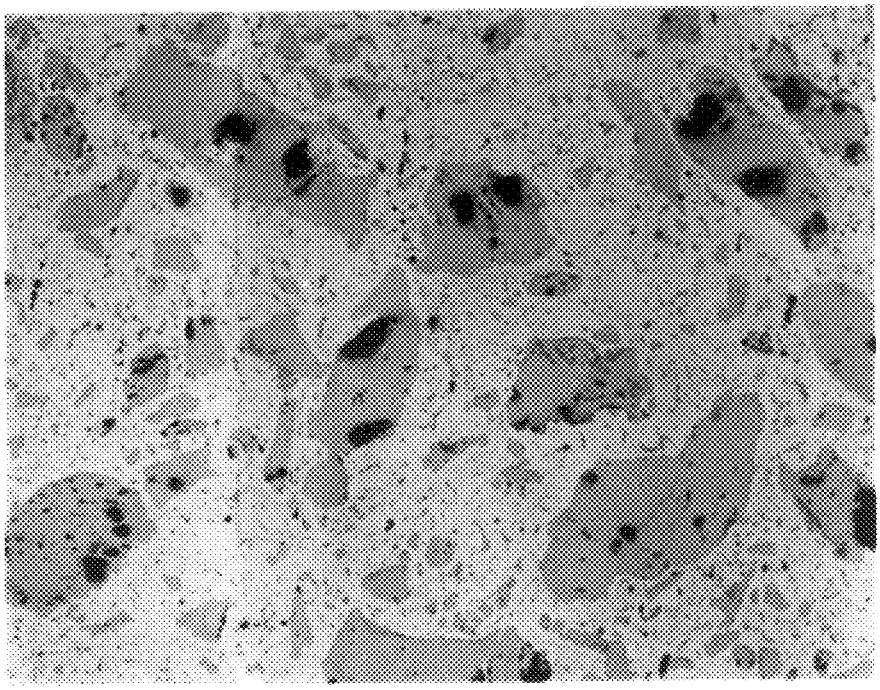
Figure 8:
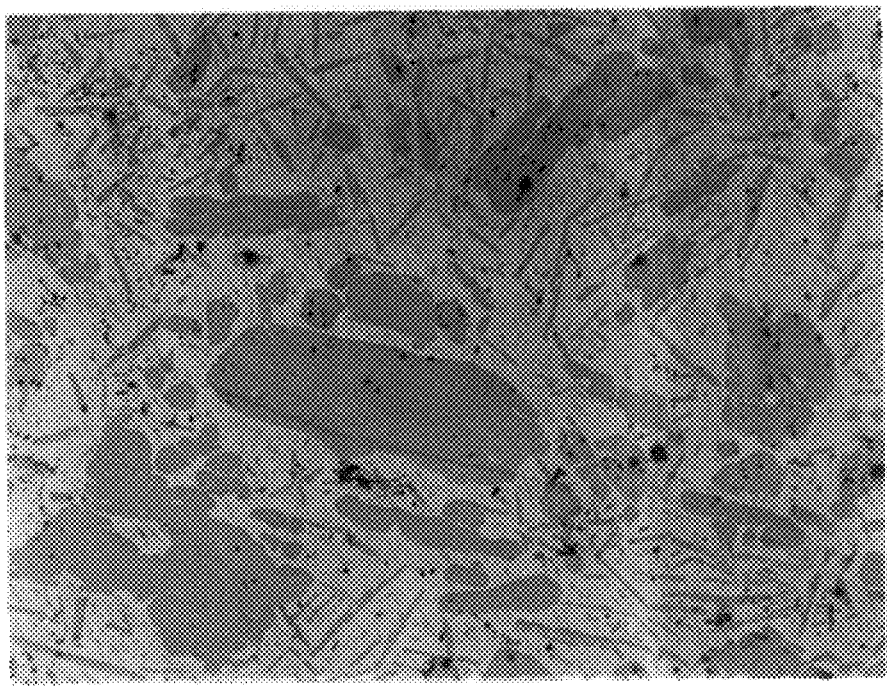

The strontium-aluminum intermetallic alloy granules are used in a variety of methods depending on which method is best suited to the application. These methods include but are not restricted to the following:

directly as a strontium enriched master alloy. Typical methods for direct addition include addition to the surface of a quiescent or agitated melt, addition to a vortex created by mechanically or otherwise mixing the melt, pneumatic injection through a submerged device such as a lance, tuyere or suitably designed rotary degasser, a pour over method where liquid metal is poured on top of the granules, and plunging the granules below the melt surface using a suitably designed device such as a cage or canister.

mixing the strontium-aluminum intermetallic alloy granules with other particles such as aluminum granules. These mechanical mixtures can then be compacted into briquettes, tablets or the like or consolidated by cold or hot extrusion into rods or other suitable shapes. These compacted or consolidated mixtures are subsequently used as the master alloy addition for adding strontium to the melt. FIG. 6 shows a photomicrograph of 10% Sr-90% Al alloy rod prepared by continuous extrusion of a mechanical mixture of aluminum granules and 45% Sr-55% Al intermetallic alloy granules ($Al_4Sr$). The three-dimensionally discrete nature of the intermetallic phase in FIG. 6 is distinctly different from the three-dimensional network of interconnected primary $Al_4Sr$ intermetallic plates existing in known strontium-aluminum eutectic alloys cited by the prior art.

physically entraining the strontium-aluminum intermetallic alloy granules into a melt whose temperature is maintained below the melting point of the intermetallic alloy granules. This melt may consist of but is not restricted to pure aluminum or a strontium-aluminum alloy. By physically entraining the intermetallic alloy granules into a melt maintained below the granules' melting point, the intermetallic alloy granules through proper care can effectively be maintained in physical suspension as three-dimensionally discrete solid strontium-aluminum intermetallic alloy particles within a molten base alloy which may or may not contain strontium. This liquid-solid mixture can then be cast into ingots, billets and the like and can be used as a strontium enriched master alloy either directly or after extrusion of the billets into rods or the like. FIG. 7 shows that this type of enriched strontium-aluminum master alloy is unlike known strontium-aluminum master alloys which as shown in FIG. 2 contain an interconnected network of primary $Al_4Sr$ plates in a eutectic matrix. With this invention the strontium is present in three-dimensionally discrete strontium enriched intermetallic particles which are not interconnected. The matrix can be either aluminum or aluminum-strontium alloy. FIG. 8 illustrates how the intermetallic $Al_4Sr$ plates are broken up when a 20% Sr alloy is prepared by entraining the appropriate amount of $Al_4Sr$ intermetallic granules in a 10% Sr-90% Al base alloy which forms the matrix.

The strontium-aluminum intersetallic alloy granules can be used with these methods to add strontium to a melt for applications such as but not restricted to modifying acicular silicon in aluminum-silicon castings and modifying intermetallic phases in aluminum extrusion alloys.

An important distinction between the current invention and the eutectic containing master alloys cited in the prior art is the acceptable size of the primary phase intermetallic alloy. In the prior art, repeated attempts are made to reduce the size and quantity of the $Al_4Sr$ primary phase intermetallics by the addition of titanium, boron and by atomization. As indicated in U.S. Pat. No. 4,576,791 the two-dimensional size of the primary phase $Al_4Sr$ intermetallic viewed through a microscope had to be reduced to 100 microns or less to enable an increase in the strontium concentration of the master alloy to 20% Sr by weight. A further size reduction to 10 microns and less was required to achieve 35% Sr concentrations.

Unlike these prior teachings, the present invention utilizes three-dimensionally discrete intermetallic alloy granules with minimal or no eutectic phase present which, depending on the method of use, enable rapid dissolution and high strontium recovery even up to sizes of approximately 5000 microns (5 mm). As illustrated in Table II of the Example 1 below, when added directly to a stirred vortex, the intermetallic alloy granules as described in the present invention actually dissolve faster when sized between −1651+147 microns than when sized at minus 147 microns. This improvement with increasing screen size is completely unexpected given the efforts cited in the prior art to reducing the size of the $Al_4Sr$ primary phase intermetallics present in conventional eutectic containing alloys.

In the following examples, the strontium-aluminum intermetallic alloy granules were prepared by melting and alloying to the correct composition, casting into blocks and crushing and grinding the blocks to granules.

EXAMPLE 1

Direct addition of strontium-aluminum intermetallic alloy granules to a vortex

Several experiments were conducted in which strontium-aluminum intermetallic alloy granules were added directly to a 356 aluminum-silicon alloy melt into a vortex created by a mechanical mixer operating at approximately 300 rpm. As detailed in the Table II below, experiments were conducted at two melt temperatures (700 & 750° C.) using granules of different alloy composition and screen size distribution.

TABLE II

Results of Direct Addition of Sr—Al Intermetallic Alloy Granules to a Vortex in 356 Al—Si Alloy Melts

| Intermetallic Alloy Granules | | Screen Size, | Melt Temperature | Max. Sr Recovery, | Time (min.) To Max. Sr |
|---|---|---|---|---|---|
| % Sr | % Al | μ | ° C. | % | Recovery |
| 75 | 25 | −147 | 700 | 82 | 10 |
| 50 | 50 | −147 | 700 | 77 | 10 |
| 40 | 60 | −147 | 700 | 70 | 10 |
| 80 | 20 | −147 | 750 | 93 | 10 |
| 75 | 25 | −147 | 750 | 100 | 10 |
| 65 | 35 | −147 | 750 | 100 | 10 |
| 60 | 40 | −147 | 750 | 100 | 2 |
| 45 | 55 | −147 | 750 | 81 | 10 |
| 40 | 60 | −147 | 750 | 70 | 10 |
| 80 | 20 | −417 + 147 | 750 | 91 | 2 |
| 60 | 40 | −417 + 147 | 750 | 93 | 2 |
| 60 | 40 | −417 + 147 | 750 | 95 | 2 |
| 62 | 38 | −1651 | 700 | 98 | 2 |

The results of the above experiments indicate excellent strontium recovery for all intermetallic alloy compositions. Very rapid dissolution was achieved (2 minutes or less) at melt temperatures of 700° C. and 750° C. for larger granules which had screen sizes ranging from −1651μ to +147μ. Excellent strontium recovery is also achieved with −147μ sized granules; however, the dissolution time is longer probably a result of surface tension difficulties giving rise to poorer wettability of the fine granules by the melt.

The results from this example are surprising. The improvement in dissolution rate with increasing size of the intermetallic alloy is unexpected given the teaching of the prior art based on eutectic containing alloys. Also the absolute size at −1651μ for the intermetallic alloy granules is significantly larger than the allowable intermetallic phase size in the prior art of −100μ for eutectic containing alloys with a maximum 20% Sr and nominally −10μ for eutectic containing alloys with a maximum of 35% Sr. The excellent dissolution rates and strontium recoveries at melt temperatures greater than 720° C. are also unexpected for intermetallic alloys containing greater than 44% Sr.

EXAMPLE 2

Direct addition of strontium-aluminum intermetallic alloy granules by pneumatic injection Several experiments were conducted in which strontium-aluminum intermetallic alloy granules were added directly to a 356 aluminum-silicon alloy melt by pneumatic injection. These injection trials were carried out by blowing suspended strontium intermetallic alloy granules down the central bore in the shaft of a rotary degasser at which point the granules were released subsurface into the melt. Granules were injected over a period of about 30 seconds and melt samples were subsequently taken and analyzed for strontium.

With 62% Sr-38% Al alloy granules sized to minus 1651 microns, 72% strontium recovery was achieved within approximately 2 minutes after the end of the alloy injection period. During this test, the degassing impeller was rotating at 300 rpm and the melt temperature was maintained at 760° C.

A second test was conducted at an impeller speed of 150 rpm and a strontium recovery of 70% was achieved within 2 minutes.

EXAMPLE 3

Direct addition of a strontium enriched master alloy prepared by entraining solid strontium-aluminum intermetallic granules in a base melt Strontium rich master alloys containing up to 23% Sr were produced by first mechanically entraining the appropriate amounts of strontium-aluminum intermetallic alloy granules into an aluminum or aluminum-strontium alloy base melt at temperatures below the granules' melting points. The resulting mixture of liquid and solid strontium enriched granules was subsequently cast into ingots and billets. The billets were subsequently extruded to ⅜ inch diameter rod. This resulted in a new type of strontium enriched master alloys containing three-dimensionally discrete particles of strontium intermetallic alloy granules. These alloys differ from conventional strontium-aluminum master alloys since the strontium is present in three-dimensional form as discrete strontium enriched granules whereas in conventional alloys the strontium is present as a three-dimensional network of interconnected intermetallic needles or plates in a eutectic matrix. Table III summarizes the results of tests where strontium enriched master alloys prepared as per this invention in either ingot or extruded form were added either to the surface or plunged into a 356 aluminum-silicon alloy melt at 760° C.

The results confirm that strontium enriched master alloys either in the form of ingot or extruded rod produced by entraining discrete solid intermetallic alloy granules in a base melt dissolve rapidly yielding high strontium recovery.

TABLE III

| Raw Materials | | | | | | | | |
|---|---|---|---|---|---|---|---|---|
| Intermetallic Alloy Granules | | Base | Final Master Alloy | | Final Alloy Addition to 356 Melt | | | |
| % Sr | % Al | Melt | Form | % Sr | Addition Method | Melt Temp. ° C. | % Sr Recovery | Time (min.) To Max. Sr Recovery |
| 45 | 55 | Al | ingot | 23 | Surface | 760 | 85 | 2 |
| 45 | 55 | Al | ingot | 23 | Plunged | 760 | 91 | 4 |
| 45 | 55 | Al | ingot | 20 | Surface | 760 | 98 | 2 |
| 45 | 55 | Al | extruded rod | 20 | Plunged | 760 | 95 | 2 |
| 45 | 55 | Al-10% Sr | ingot | 20 | Surface | 760 | 92 | 2 |

EXAMPLE 4

Direct addition of tablets formed by compacting mechanical mixtures of strontium-aluminum intermetallic granules A mechanical mixture of 33% by weight of 60% Sr-40% Al intermetallic alloy granules and 67% by weight of aluminum metal granules (both nominally minus 1651$\mu$) was prepared and compacted into tablets. The bulk composition of the tablets averaged 20% strontium by weight.

The tablets were then added to the surface of a stirred (300 rpm) 356 aluminum-silicon alloy melt maintained at 730° C.

A strontium recovery of 91% was achieved within 4 minutes after the tablets were added.

The foregoing examples are presented for the purpose of illustrating, without limitation, the product and methods of use of the present invention. It is understood that changes and variations can be made without departing from the scope of the invention as defined in the following claims.

What is claimed is:

1. A composition suitable for use as a master alloy addition to aluminum silicon alloys, comprising granules of intermetallic alloys selected from the group consisting of $Al_4Sr$, $Al_2Sr$ and AlSr, the composition consisting essentially of 40 to 81% strontium by weight.

2. A composition according to claim 1, wherein the alloy extends no more than 4% into the compositional range of eutectic containing alloys.

3. The composition according to claim 1, having essentially no AlSr eutectic phase.

4. A composition according to claim 1, wherein the granules are less than 5,000$\mu$ in size.

5. A composition according to claim 1, wherein said granules are in unconnected, free-flowing form.

6. A composition according to claim 1, comprised of said granules incorporated into an extruded rod which also contains aluminum granules.

7. A composition according to claim 1, comprised of said granules entrained into a billet of cast aluminum alloys.

8. A composition according to claim 1, wherein the granules are between 147 and 1650$\mu$ in size.

9. A composition according to claim 1, wherein said granules are three-dimensionally discrete.

* * * * *